United States Patent [19]

Gilligan et al.

[11] Patent Number: 4,882,481

[45] Date of Patent: Nov. 21, 1989

[54] AUTOMATIC BRIGHTNESS CONTROL FOR IMAGE INTENSIFIERS

[75] Inventors: Lawrence H. Gilligan; David W. Gerdt, both of Charlottesville, Va.

[73] Assignee: Sperry Marine Inc., Charlottesville, Va.

[21] Appl. No.: 259,829

[22] Filed: Oct. 19, 1988

[51] Int. Cl.[4] ..... H01J 31/50

[52] U.S. Cl. ..... 250/213 VT; 313/537

[58] Field of Search ..... 250/213 VT, 213 R; 313/529, 537, 103 CM, 105 CM

[56] References Cited

U.S. PATENT DOCUMENTS 3,864,595 2/1975 Lawrence et al. ..... 250/213 VT 4,603,250 7/1986 Contini et al. ..... 250/213 VT

*Primary Examiner*—Edward P. Westin

*Attorney, Agent, or Firm*—Seymour Levine

[57] ABSTRACT

The microchannel plate current of a microchannel plate image intensifier is sensed to generate a pulse train applied to the image intensifier photocathode for gating the image intensifier on and off with an on period proportional to the light impinging thereon. The off periods of the pulse train are sufficiently positive to repair photocathode spot damage.

5 Claims, 1 Drawing Sheet

AUTOMATIC BRIGHTNESS CONTROL FOR IMAGE INTENSIFIERS

BACKGROUND OF THE INVENTION

1. Field of the Invention

The invention relates to image intensifiers, particularly with respect to microchannel plate image intensifiers. The invention relates to the control of sensitivity and protection from damage in systems utilizing such image intensifiers.

2. Description of the Prior Art

Systems are known in the prior art utilizing image intensifiers such as the present day design of microchannel plate image intensifiers. Such systems include intensified focal plane array television camera systems as well as directly viewed intensifier systems as, for example, for periscopes. Such systems employing image intensifiers are generally limited in dynamic range so that blooming occurs when the input light level becomes high or damage occurs when the input light level becomes excessively high. The prior art systems primarily utilized automatic brightness control (ABC) to alleviate the problems by controlling the gain of the microchannel plate. The prior art automatic brightness control does not protect the photocathode of the image intensifier since such arrangement only controls gain after the photocathode which is the sensitive component of the device. This prior art control, therefore, permits damage to the photocathode of which the observer is unaware. Such automatic brightness control systems additionally have limited dynamic range and no capability of repairing accidental damage.

SUMMARY OF THE INVENTION

The invention obviates the disadvantages of the prior art by maintaining a predetermined microchannel plate gain and switching the photocathode on and off proportionately so as to provide a suitable image. The switching is effected at a frequency above the flicker perception frequency of the human eye. The total quantity of integrated light impinging upon the image intensifier results in a proportional microchannel plate current. The current is sensed and utilized to vary the pulse on time of a pulse width or pulse frequency modulator. The output of the pulse width modulator is applied to the image intensifier photocathode to turn it on for a period of time inversely proportional to the impinging light level.

Since the invention operates on the image intensifier photocathode, rather than the microchannel plate, the sensitive element is controlled rather than the observed effect. Since photocathode sensitivity and damage threshold are a function of light level times time, the sensitivity is controlled and damage is prevented. If the voltage level between on pulses is sufficiently positive with respect to the microchannel plate input voltage, spot damage which may occur on the photocathode is repaired. The invention provides improved dynamic range compared to prior art techniques. The invention utilizes time domain gain control of the image intensifier to achieve the desirable results.

DESCRIPTION OF THE PREFERRED EMBODIMENT

Figure 1:
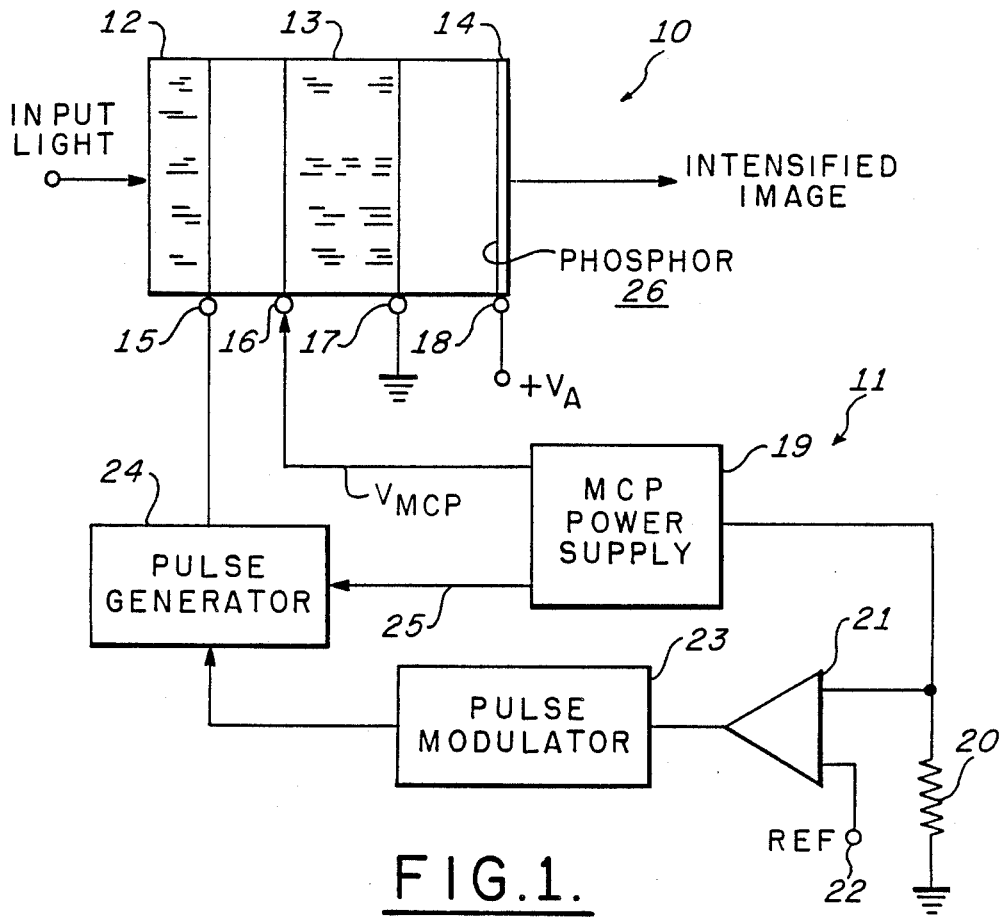
FIG. 1 is a schematic diagram illustrating a microchannel plate image intensifier and the circuitry for controlling the image intensifier in accordance with the present invention.
Figure 2:
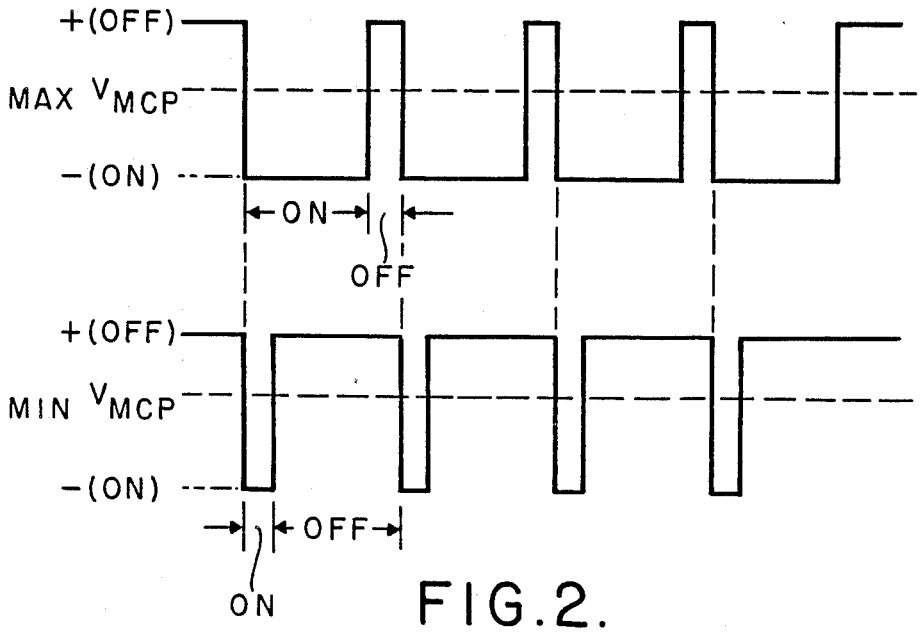
FIG. 2 is a waveform diagram illustrating pulse duty cycle control of the image intensifier in accordance with the invention.

Referring to FIGS. 1 and 2, a microchannel plate image intensifier 10 is controlled by a control feedback loop 11 to provide automatic brightness control in accordance with the invention. The image intensifier 10 includes a photocathode 12, a microchannel plate 13 and an anode 14 which includes a phosphor coating 26. Voltage potentials are applied to the image intensifier 10 at a photocathode input 15, a microchannel plate input 16, a microchannel plate output 17 and an anode input 18. The photocathode 12 emits electrons when light impinges thereon. The microchannel plate 13 multiplies the electrons flowing from the photocathode 12, which electrons are accelerated to the anode 14 where the phosphor 26 produces light proportional to the electron flux. The image intensifier 10 is operated by polarizing the photocathode 12 negative with respect of the microchannel plate input 16. When the microchannel plate input 16 is negative with respect to the photocathode 12, the image intensifier 10 is turned off and no electrons are emitted from the photocathode 12.

The control feedback loop 11 switches the photocathode 12 on and off in a manner inversely proportional to the incoming light level, in accordance with the invention, in order to provide a constant output light level. Appropriate voltage potentials, in accordance with manufacturer's specifications, are applied to the microchannel plate input 16 ($V_{MCP}$), the microchannel plate output 17 and the anode 18 ($V_A$). The microchannel plate output 17 is normally at ground potential. The control feedback loop 11 includes a microchannel plate power supply 19 that provides the microchannel plate input 16. The current through the microchannel plate power supply 19 is monitored by a resistor 20, the microchannel plate current being a measure of the light level impinging on the photocathode 12. The microchannel plate current monitored by the resistor 20 is amplified and scaled by an amplifier 21 so that the output of the amplifier 21 provides an analogue of the difference between the light level out of the anode phosphor and an arbitrary reference provided at a terminal 22.

The output of the amplifier 21 controls a pulse modulator 23 to produce a series of pulses having constant width but variable repetition rate in accordance with the signal from the amplifier 21. Alternatively, the pulse modulator 23 may produce a series of pulses at a constant repetition rate but with variable pulse width controlled by the output of the amplifier 21. In either embodiment, the on time of the image intensifier 10 is controlled to be inversely proportional to brightness. The pulse train from the pulse modulator 23 is level shifted and amplified by a pulse generator 24 and applied to the image intensifier photocathode 12 at terminal 15. The pulse generator 24 receives power from the MCP power supply 19 via a lead 25.

FIG. 2 illustrates the pulses that drive the photocathode 12 negative so that the image intensifier 10 is turned on. The off level between the pulses is sufficiently positive so that spot damage which may occur on the photocathode is repaired.

The chief cause of photocathode damage resulting from excess light level upon the photocathode is ion damage. That is, ions which are unavoidably present at the microchannel plate input migrate to the photocathode when excessively large quantities of electrons are emitted from the photocathode as a result of excessive light. The ions are positively charged, and the photocathode is negative, so they are attracted. When the ions impinge upon the photocathode, they begin to diffuse into the surface. As long as the photocathode is negatively charged, or neutral, there is no reason for the ions to depart. The ion "poisoning" of the photocathode reduces its sensitivity, so that a negative version of the bright scene which caused the damage is observed. The common designation of the phenomenon is "image burn-in". If, however, a very strong positive potential is applied to the photocathode before the ions diffuse very far into the photocathode substance, the ions are rejected from the photocathode and returned to the microchannel plate input. This positive potential must be sufficiently large to reject the ions from the photocathode, and must be applied for a time period sufficiently long to allow the relatively slow ions to arrive at the microchannel plate (>20 usec.) prior to turn-on.

FIG. 2 illustrates the pulse width modulated embodiment of the invention. The upper waveform illustrates maximum on time and minimum off time whereas the lower waveform illustrates minimum on time and maximum off time. When minimum light level is perceived by the sensor 10, 19, and 20, the pulse duty factor is larger than 0.8 so that 80% or more of maximum sensitivity is effected. When maximum light levels occur, the pulse duty factor may be decreased to $10^{-7}$. Thus, more than $10^6$ dynamic range is achieved. Because of the invention, damage to the photocathode cannot occur by observing any naturally lit scene and damage which may occur from excessive transient light will be repaired unless thermal damage occurs. The invention, therefore, provides a gated pulse image intensifier gain control providing advantages over the prior art as discussed therein.

While the invention has been described in its preferred embodiment, it is to be understood that the words which have been used are words of description rather than limitation and that changes may be made within the purview of the appended claims without departing from the true scope and spirit of the invention in its broader aspects.

I claim:

1. Brightness control apparatus for an image intensifier having a photocathode, a microchannel plate, and an anode, comprising:

monitoring means for monitoring the current drawn by said microchannel plate in response to the light level impinging on said photocathode and for providing a pulse control signal in accordance therewith, and pulse generating means responsive to said pulse control signal for providing a pulse train to said photocathode so that said image intensifier is gated on and off with an on period proportional to said light level impinging on said photocathode.

2. The apparatus of claim 1 wherein said image intensifier includes a microchannel plate input and a microchannel plate output, said apparatus further including power supply means for applying suitable operating potentials to said microchannel plate input, said microchannel plate output and said anode to effect substantially maximum gain when said photocathode is pulsed on by said pulse generating means.

3. The apparatus of claim 1 wherein said image intensifier includes a microchannel plate input and a microchannel plate output, said apparatus further including power supply means for applying suitable operating potentials to said microchannel plate input, said microchannel plate output and said anode.

4. The apparatus of claim 3 wherein said power supply means includes a microchannel plate input power supply for applying a suitable potential to said microchannel plate input, and said monitoring means includes a resistor through which said microchannel plate current flows for providing said pulse control signal.

5. The apparatus of claim 1 wherein said pulse train is sufficiently positive during the off periods of said image intensifier so that spot damage which may occur on said photocathode is repaired.

* * * * *